United States Patent [19]

Ream et al.

[11] 4,397,373

[45] Aug. 9, 1983

[54] MOBILE PEDESTAL SCAFFOLD

[76] Inventors: Michael D. Ream, 3164 Condit Rd., Lafayette, Calif. 94594; Paul C. Guignard, 1863 Lambeth La., Concord, Calif. 94518

[21] Appl. No.: 342,092

[22] Filed: Jan. 25, 1982

[51] Int. Cl.[3] ..... E04G 1/34; E04G 1/30; E04G 1/24

[52] U.S. Cl. ..... 182/17; 182/63; 182/102; 182/116; 182/127; 182/152

[58] Field of Search ..... 182/17, 63, 145, 146, 182/141, 148, 101, 116, 127, 152, 102

[56] References Cited

U.S. PATENT DOCUMENTS

| | | | |
|---|---|---|---|
| 294,860 | 4/1884 | Dye | 182/17 |
| 2,409,622 | 10/1946 | Gottfried | 182/172 |
| 2,969,123 | 1/1961 | Jamerson | 182/17 |
| 3,176,794 | 4/1965 | Evans | 182/17 |
| 3,631,940 | 1/1972 | Richins | 182/148 |
| 3,874,477 | 4/1975 | Hedstrom | 182/63 |
| 3,934,681 | 1/1976 | Herrell | 182/148 |
| 4,015,686 | 4/1977 | Bushnell | 182/148 |
| 4,194,591 | 3/1980 | Fisher | 182/17 |

*Primary Examiner*—R. P. Machado

*Attorney, Agent, or Firm*—Phillips, Moore, Lempio & Finley

[57] ABSTRACT

A pedestal scaffold having a base member with an upwardly extending mast and a work cage mounted thereon for vertical movement. Retractable outriggers with ground-engageable pads are extendable outwardly on the cage side of the scaffold and lockable into support position to provide a large support area for the elevated work cage. Ground-engageable casters are mounted on the base and the cage and the cage is releaseably locked to the base. When the base and cage are locked together, the scaffold can be moved horizontally on the base and cage casters with the mast being vertical. When the cage is unlocked for vertical movements, scaffold weight is transferred from the cage casters to the non-rolling outrigger pads so that the scaffold cannot be moved along the ground when the cage is elevated. If the cage-side outriggers are not properly braced, the cage can be unlocked from the base but cannot be raised off the ground.

7 Claims, 8 Drawing Figures

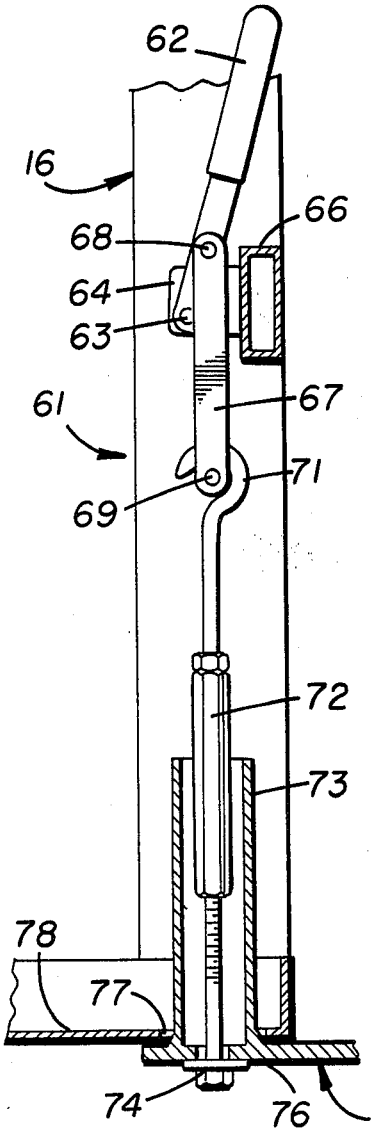
FIGURE 5
FIGURE 4
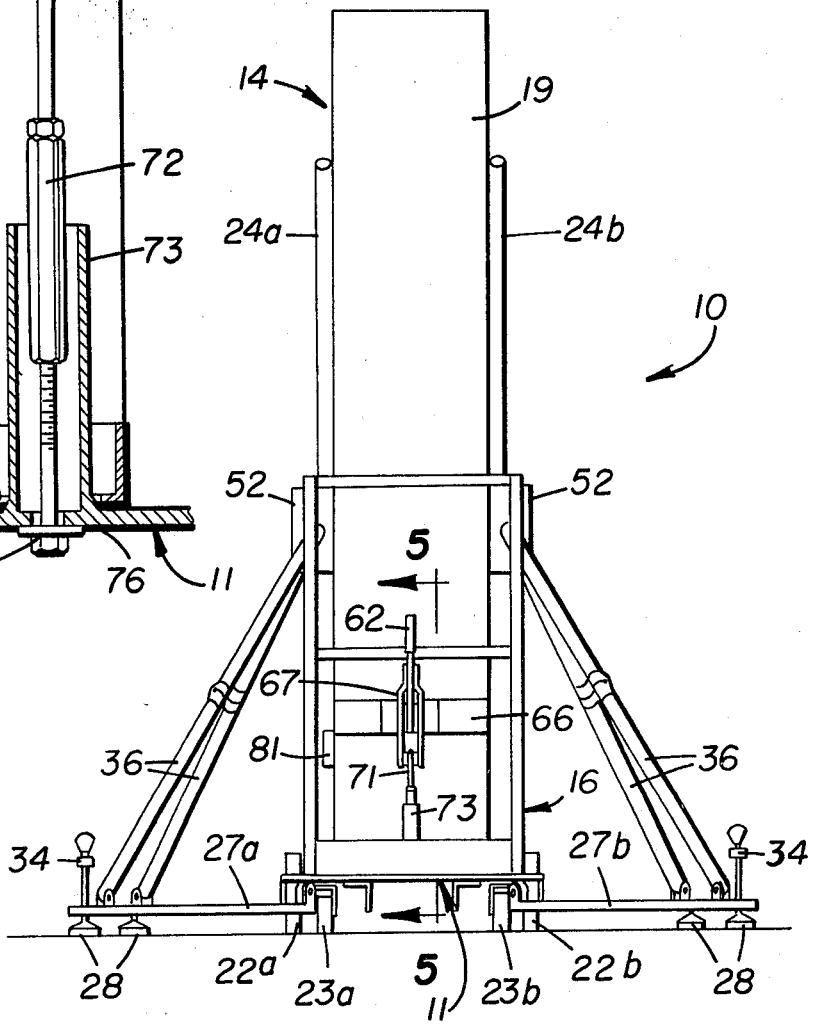

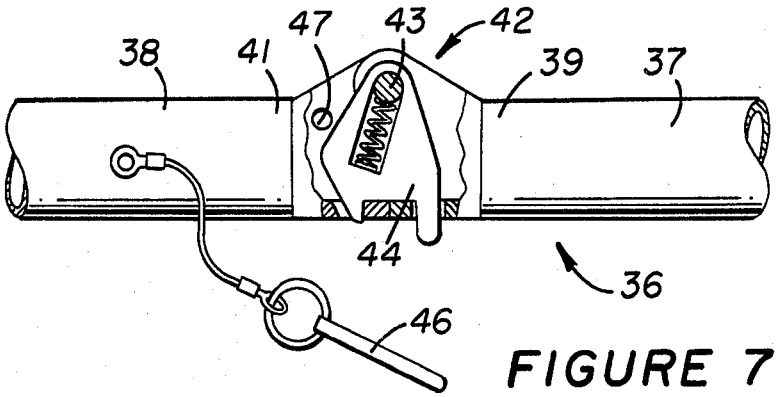
FIGURE 7
FIGURE 8
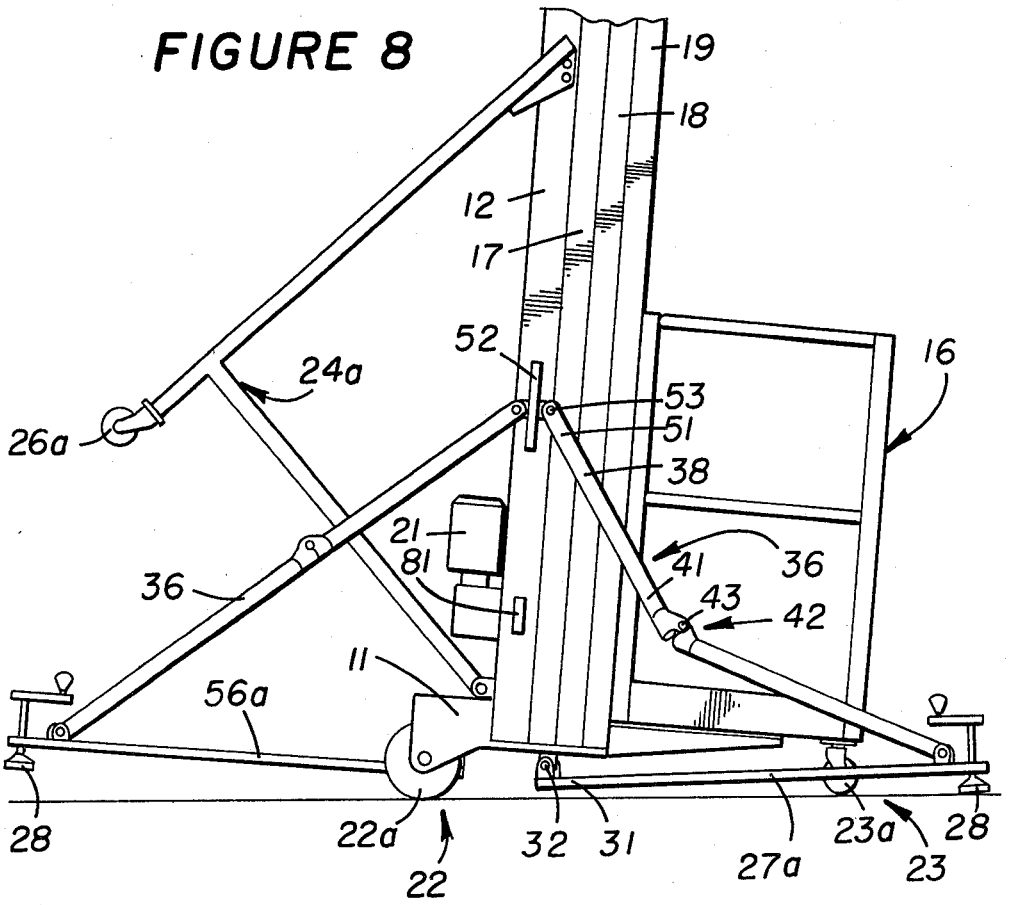

MOBILE PEDESTAL SCAFFOLD

DESCRIPTION

1. Technical Field

This invention relates to pedestal scaffolds of the type wherein an upright mast is mounted on a base frame member, a work cage is mounted on the mast for vertical movement and the base frame has casters thereon for movement of the scaffold from place to place.

2. Background Art

Pedestal scaffolds generally have a relatively small base member so that the scaffold can be moved through narrow aisles and corridors to a point of use and also have outrigger members which can be extended horizontally from the base, the outrigger members carrying thereon ground-engageable pads to provide a large base support area for the scaffold when in use.

Safe use of such scaffolds requires that the outriggers be deployed and properly set to protect the workman in the elevated work cage. Some pedestal scaffolds have a distinct deficiency in that they will allow the workman to ascend without the outriggers being set. Since setting of the outriggers requires some degree of effort on the part of a workman, such scaffolds carry with them the chance that a workman might misuse the scaffold and consider that it would be too bothersome for him to set the outriggers for a particular piece of work.

Another problem resulting from scaffold misuse involved with pedestal scaffolds is that a particular job, such as the replacement of ceiling lights, may call for frequent movement of the scaffold from place to place. Many scaffolds of this type have lockable casters to permit the scaffold to be moved along the floor when the casters are unlocked and to permit the scaffold to be immobilized when the casters are locked. However, the workman, in complete disregard of manufacturer's recommendations and safety regulations, may deliberately choose to leave the casters unlocked when he is using the scaffold. By so doing, he is able to stay in the elevated work cage and move the scaffold along the floor by grasping the ceiling or the wall and exerting a horizontal pull to roll the scaffold on its unlocked casters. Or else, he might have another workman on the floor push the scaffold along the floor. In either case, if one or more of the casters encounters an obstacle on the floor, there is a possibility that the scaffold could be tipped over.

To overcome this latter example of scaffold misuse, some pedestal scaffolds, such as shown in U.S. Pat. No. 4,194,591, have provision for automatically raising the casters off of the floor when the outriggers are deployed. As a consequence, the scaffold cannot then be moved. However, such scaffolds have a disadvantage in that some of the outriggers must be retracted before the scaffold can be moved, making it somewhat cumbersome to use the scaffold when many changes in position are required.

It is an object of the present invention to provide a mobile pedestal scaffold which may be rolled along on its casters with the mast thereof vertical, which cannot have its work cage elevated unless the outriggers are safely deployed, and which can be moved horizontally with all outriggers deployed if, but only if, the work cage is at a fully lowered position.

DISCLOSURE OF THE INVENTION

The present invention is directed to overcoming one or more of the problems set forth above and towards fulfilling the above object.

In general, the present invention provides a pedestal scaffold having a base member, an upwardly extending mast mounted on the base member and a work cage mounted on the mast for vertical movement relative to the base. First and second caster means are mounted on the base member and the work cage respectively, the work cage and base members being releasably held together against vertical movement when the work cage is in the lowered position. Outriggers with non-rolling pads thereon provide, in conjunction with the base casters, a base support area for the work cage. Release of the work cage from the base members insures transfer of weight from the work cage caster means to the outrigger pads when the work cage is elevated, thereby preventing movement of the scaffold when in elevated use. If the outriggers are not set, the released work cage cannot be raised off the ground.

Other aspects and advantages of the invention will be set forth in the course of the following detailed description.

BRIEF DESCRIPTION OF THE DRAWINGS

FIG. 4 is an elevational view of the scaffold in its use position and from the work cage side thereof.

FIG. 5 is a sectional detail, taken on line 5—5 of FIG. 4, of the latch for releasably securing the cage and base frame together.

FIG. 7 is a detail view, partly in section, of one of the outrigger brace latches.

FIG. 8 is a side elevational view of the scaffold illustrating what will occur if the front outrigger braces are not locked and the work cage is unlatched from the base frame.

DESCRIPTION OF THE PREFERRED EMBODIMENT

Figure 1:
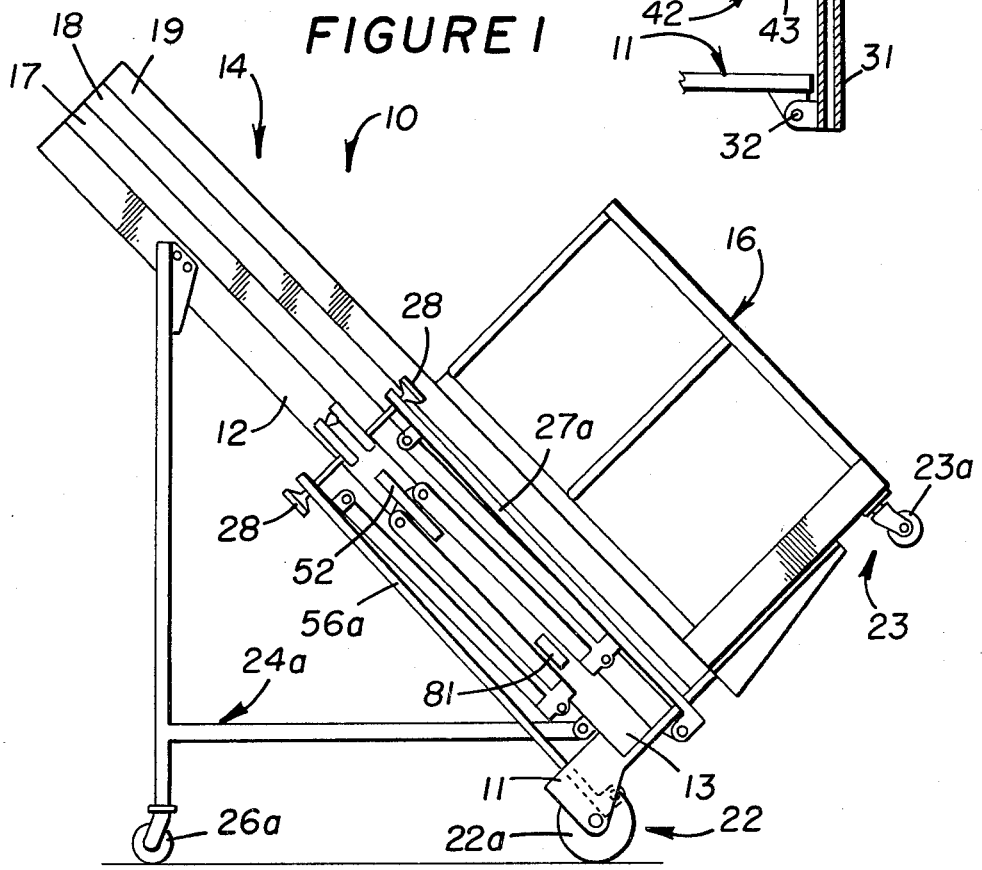
FIG. 1 is a side elevational view of a pedestal scaffold constructed in accordance with the invention, with the outriggers thereof folded up in storage position and the scaffold supported on its rear wheels for rolling movement.

Referring now to the drawings, wherein a preferred embodiment of the invention is shown, the pedestal scaffold 10 comprises a base member 11 and a vertically extending mast 12 having its lower end 13 mounted on the base member 11. A conventional telescopic elevating mechanism 14 mounts work cage 16 on mast 12 for vertical movement between a lower position adjacent the base member, i.e. as illustrated in FIGS. 1 and 4, and upper positions spaced thereabove. As illustrated herein, elevating mechanism 14 comprises three vertical stages 17, 18 and 19, stage 17 being secured to mast 12 for vertical movement thereon and work cage 16 being secured to stage 19 for vertical movement thereon. The mast 12, telescopic stages 17,18 and 19 and work cage 16 are conventionally interconnected, e.g. by hydraulic cylinders and chains, (not shown) which are powered by motor 21, so that the telescopic stages and work cage will simultaneously raise and lower. A conventional control unit (not shown) is mounted on the work cage so that a workman thereon can control motor 21 and the raising and lowering of the work cage.

The scaffold 10 has a first caster means 22 on base member 11 and a second caster means 23 on the work cage 16. As shown herein, caster means 22 includes two spaced-apart ground-engageable casters 22*a* and 22*b* mounted on the base member 11 and on a transverse axis on the side of the base member away from the work cage 16. Caster means 23 includes a pair of spaced-apart ground-engageable casters 23*a* and 23*b* mounted on the work cage 16 on the side thereof away from the base member 11. Casters 22*a*, 22*b*, 23*a* and 23*b* are mounted on the base member and work cage so that the mast 12 will be vertical when the casters are on level ground and the base member and work cage are locked together against relative vertical movement.

Although four casters are preferably used to provide maximum stability when the scaffold is supported thereby, three casters could be used to provide a three-point support. In such case, each of the first and second caster means 22 and 23 would have at least one caster, there being at least three casters in all.

Casters 22*a* and 22*b* are preferably of the locking variety wherein the casters may be locked against rotation or unlocked for rolling movement of the scaffold.

The scaffold 10 is preferably provided with parallel and spaced apart wheel support frames 24*a* and 24*b* fixed to the base member 11 and mast 12 on the side thereof away from work cage 16. When desired, the scaffold may be tilted to the position illustrated in FIG. 1, so that the scaffold will rest on the wheels 26*a* and 26*b* and casters 22*a* and 22*b*. This will decrease the overall height of the scaffold, allowing it to be rolled through standard-height doorways.

Figure 2:
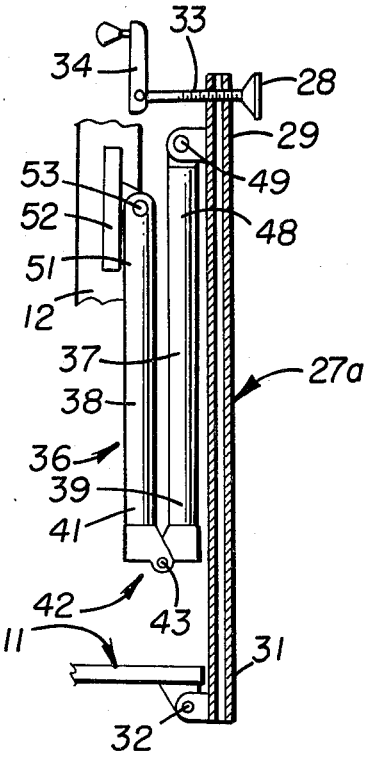
FIG. 2 is a detail of the scaffold showing one of the outrigger braces in folded position.
Figure 3:
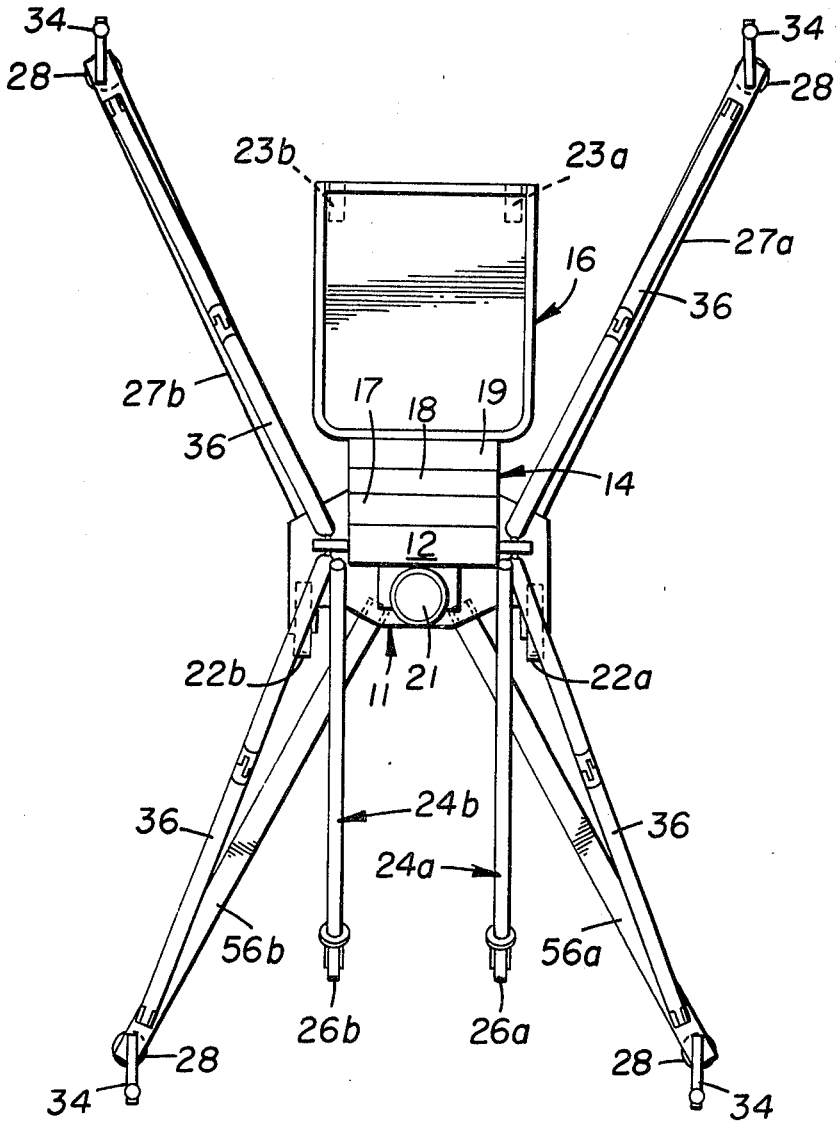
FIG. 3 is a plan view of the scaffold in its use position and with its outriggers deployed.

Scaffold 10 further includes first and second forward, or cage-side, elongated outrigger members 27*a* and 27*b* each having a non-rolling ground-engageable pad 28 on the pad end 29 thereof. Each outrigger member comprises an elongated tubular beam having its other, or base, end 31 pivotally connected to base member 11 by a horizontal pivot pin 32 so that the outrigger 29 can be pivoted upwardly to a retracted storage position parallel to mast 12, i.e. as shown in FIGS. 1 and 2, or downwardly to a generally horizontal use position, i.e. as shown in FIGS. 3 and 4, wherein the non-rolling pad 28 is engageable with the ground outwardly from the base member 11. Pad 28 is mounted on screw 33 threaded through the outrigger beam so that the spacing between the pad and the beam may be adjusted by rotation of handle 34.

Each outrigger member 27*a* and 27*b* has associated therewith a lockable brace 36, each brace 36 comprising first and second tubes 37 and 38 each having first ends 39 and 41 pivotally converted together for pivotal movement of the brace tubes between a generally parallel relation (FIG. 2) and an in-line relation (FIG. 6) by means of a locking hinge 42 having a hinge pin 43. A suitable lock member 44 (FIG. 7) is provided for automatically locking the brace tubes against relative movement therebetween when the tubes have been brought into their in-line relation, and for manually unlocking the tubes so that they can be moved from their in-line relation. The releasable locking hinge 42 disclosed herein (FIG. 7) is more fully shown and described in U.S. Pat. No. 3,187,373. Retainer pin 46 is insertable through aperture 47 of the locking hinge to prevent inadvertent unlocking movement of lock member 44 when the brace tubes are locked together in in-line relation.

The other end 48 of the first brace tube 37 is pivotally connected to the pad end 29 of the outrigger by pivot pin 49, while the other end 51 of the second brace tube 38 is pivotally connected to bracket 52 by pivot pin 53. Bracket 52 is fixed to mast 12 at a location above base member 11.

As illustrated herein, the lockable braces 36 and pivot connections 32 for the outrigger members 27*a* and 27*b* constitute a securing means for connecting the other ends 31 of the first and second outrigger members 27*a* and 27*b* to the brace member 11 and for holding the pad ends of these outrigger members outwardly from the base member and against vertical movement relative to the base member and for there positioning the pads 28 of the first and second outrigger members 27*a* and 27*b* relative to the first caster means 22 such that the center of gravity of the work cage 16 is vertically within the generally horizontal area defined by the outrigger pads 28 and the casters 22*a* and 22*b* of the first caster means 22.

Third and fourth outrigger members 56*a* and 56*b*, each having a non-rolling ground-engageable pad 28 thereon are also provided. Pivot pin connections 57 between these outrigger members and base member 11 and lockable braces 36 similarly provide securing means to connect the third and fourth outrigger members 56*a*, 56*b* to the base member 11 and to hold the pad ends of these outriggers outwardly from the base member 11 and in generally opposite directions from the first and second outrigger members 27*a* and 27*b* when the latter are in their outward, or use, positions, and for holding the pads 28 of outrigger members 56*a* and 56*b* against vertical movement relative to the base member 11.

A means 61 (FIGS. 4 and 5) is provided for releasably holding the work cage 16 to the base member 11 to prevent relative vertical movement therebetween when the work cage 16 is in its lower position. As illustrated herein, means 61 includes a manually-operable lever 62 pivotally mounted at 63 to bracket 64 which is fixed to cross-tube 66 of work cage 16. Links 67, pivotally connected to lever 62 at 68, have a horizontal pin 69 at their lower ends engageable with hook 71. The body 72 of hook 71 extends down through sleeve 73 which is fixed to base member 11 and has a lower head 74 engageable with the underside 76 of base member 11. Sleeve 73 extends upwardly through aperture 77 in the floor 78 of work cage 16. As is seen in FIG. 5, the over-center relation of lever 62 holds the work cage 16 firmly against base member 11 so that relative vertical movement therebetween is prevented. The work cage can be released by rotating lever 62 in a counterclockwise direction about pivot pin 63 to move links 67 downwardly so that pin 69 can be removed from hook 71.

Operation

The scaffold 10 is preferably moved to a work site by folding the outrigger members upwardly against the mast 12, by tilting the mast so that the scaffold rests on wheels 26*a* and 26*b* and casters 22*a* and 22*b* (i.e. as in FIG. 1), and by then rolling the scaffold to its point of use.

When there, the scaffold is tipped so that it rests on the four casters 22*a*, 22*b*, 23*a* and 23*b*, the mast 12 then being vertical if the floor is level. The scaffold can then be moved on these casters to the exact point desired. The base member casters 22*a* and 22*b* are then locked and the outrigger members 27*a*, 27*b* 56*a* and 56*b* are then unfolded from mast 12 to deploy the outrigger members in their use positions with the outrigger pads being spaced outwardly from the base member 11. The workman will then pull the tubes 36 and 37 of each outrigger brace 36 upwardly and outwardly to move the tubes into an in-line relationship so that the locking hinge 42 will lock the brace 36 into support position.

The outrigger pads 28 will then be adjusted to engage the floor with the mast 12 being vertical. Depending on the amount that the pads 28 are moved downwardly from the outrigger during such adjustment, none, some, or all of the casters 22*a*, 22*b*, 23*a* and 23*b* may be in contact with the floor after pad adjustment.

The work cage 16 is then released from base member 11 by operating handle 62 to disengage pin 69 from hook 71. With the work cage 16 now free to move upwardly relative to base member 11, the weight of the scaffold that had been borne by casters 23*a* and 23*b* will now be shifted to pads 28 of the first and second outriggers 27*a* and 27*b*.

Figure 6:
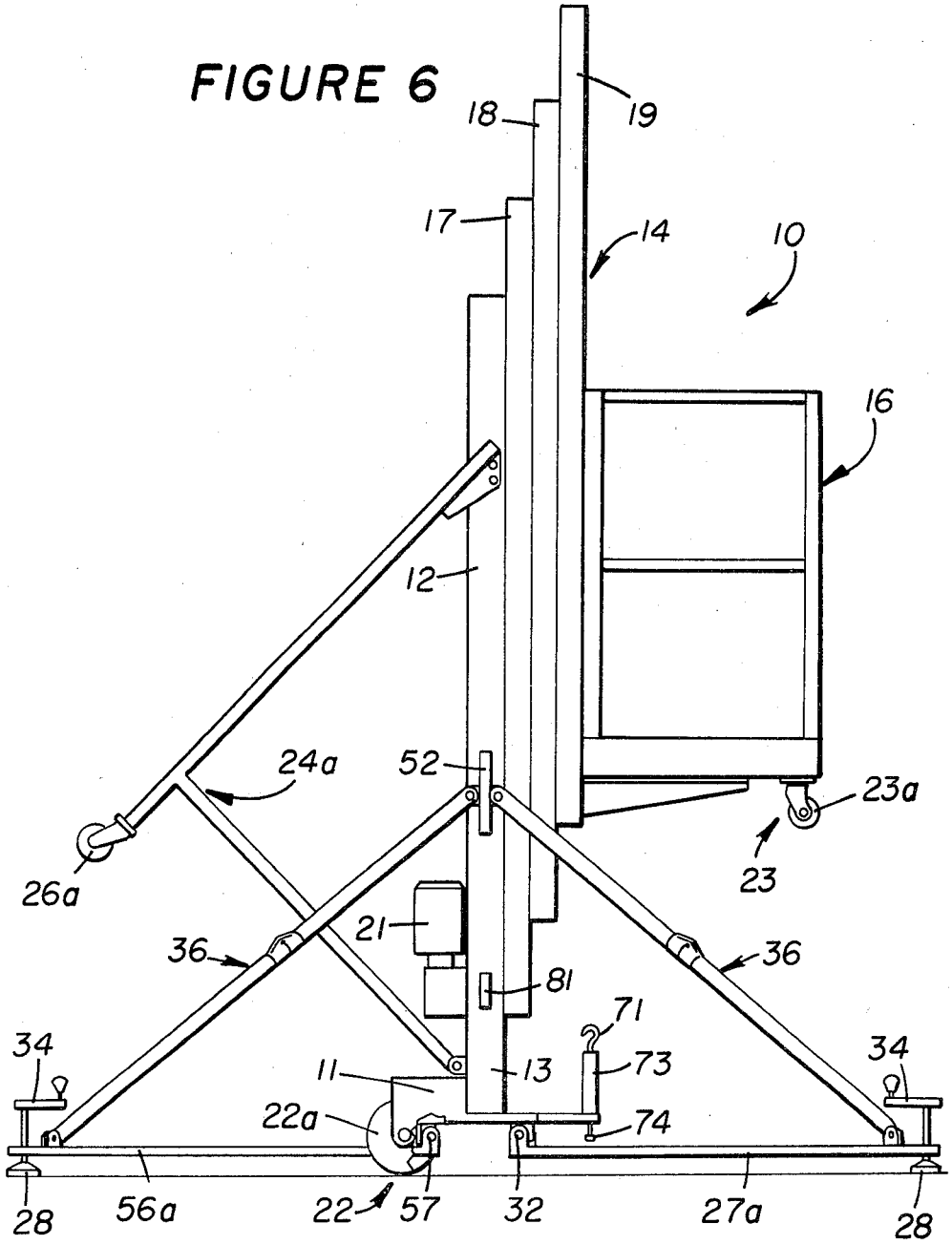
FIG. 6 is a side elevational view of the scaffold with the outriggers deployed and the work cage partially elevated.

Operation of motor 21 will then cause the stages 17, 18 and 19 of the elevating mechanism and work cage 16 to extend upwardly, in a manner as illustrated in FIG. 6. Typically, with a mast of approximately eight feet in height, a three-stage elevating mechanism will raise the work cage to about 24 feet off the floor.

The scaffold cannot now be moved horizontally on the floor. If the pads 28 had been adjusted so that the base casters 22*a* and 22*b* are off the floor it would be possible for a workman to unscrew the pass 28 on the rear outriggers 56*a* and 56*b* so that the base casters 22*a* and 22*b* are lowered onto the floor, with the pads 28 in the rear outriggers being raised off the floor. However, even if the casters 22*a* and 22*b* were then to be unlocked for rolling, the scaffold could not be moved laterally because a very substantial portion of the weight of the scaffold rests on the non-rolling pads 28 of the front outriggers 23*a* and 23*b*.

In order to move the scaffold along the floor, the work cage 16 must be lowered to its lowermost position and then locked to the base member 11. With the work cage and base member locked together, the outrigger pads 28 of the deployed outriggers can all be adjusted so that they are slightly above the floor, thereby transferring the scaffold weight back onto the four casters. The scaffold can then be rolled on these casters, with the outriggers deployed and the braces 36 all locked, to a desired point. The pads are again adjusted to engage the floor and the work cage is again unlatched for vertical movement.

The present scaffold has an additional advantage in that it is not possible to raise the work cage if the front outriggers 27*a* and 27*b* are not properly locked. For example, a workman might have rolled the scaffold to a point of use, and then released the outriggers so that they swing downwardly into their use position, but he may have forgotten to lock the locking hinges 42 of the braces 36. With the braces 36 unlocked, all of the weight of the scaffold will be borne by the four casters. FIG. 8 illustrates what will happen if the workman now releases the work cage 16 from the base member 11. Since the unbraced front outriggers 27*a* and 27*b* cannot support any scaffold weight, the weight of the scaffold will continue to be borne by all four casters. However, since the work cage 16 has now been released from the base member 11, it will move upwardly relative to the base member causing the base member 11 to pivot downwardly about the base casters 22*a* and 22*b* and the mast 12 to tilt considerably from vertical. This will immediately be noticed by the workman who will then relatch the cage and lock the outrigger braces.

Even if the tilt of the mast should go unnoticed, the workman could not cause the cage to be elevated. If he tried to do so, the cage would move upwardly relative to mast 12. However, since the cage casters 23*a* and 23*b* would remain in weight supporting contact with the floor, all that would occur because of the movement of the cage upwardly on the mast 12 is that the mast would tilt more and more from vertical. Preferably, a conventional tilt switch 81 is mounted on mast 12 and interconnected with the control for motor 21 so that the motor cannot be operated unless the mast is substantially vertical. In such case, it would be impossible for a workman to even try to raise the cage beyond the limit permitted by the tilt switch if the front outriggers were not deployed and properly braced, and if the scaffold tilts to the position shown in FIG. 8. In addition, such a switch 81 will also serve to prevent inadvertent mast extension when the scaffold is in its rolling movement position of FIG. 1.

We claim:

1. A pedestal scaffold comprising:

a base member, a vertically extending mast having a lower end mounted on said base member, a work cage mounted on said mast for vertical movement between a lower position relative to said base member and an upper position spaced thereabove, means for releaseably holding said cage to said base member to prevent relative vertical movement therebetween when said cage is in its lower position and is held to said base member, a first caster means on said base member and a second caster means on said work cage, each caster means incluing at least one ground-engaging caster, there being at least three casters in all, first and second elongated outrigger members, each having a ground-engageable pad at one end thereof, securing means for connecting the other end of each of said first and second outrigger members to said base member and for holding the pad ends of said outrigger members outwardly from said base member and against vertical movement relative to said base member and for there positioning the pads of said first and second outrigger members relative to said first caster means such that the center of gravity of said work cage is vertically within the generally horizontal area defined by said pads and said first caster means.

2. A pedestal scaffold as set forth in claim 1, and further including:

means for adjusting the spacing between each ground-engageable pad and the outrigger member on which it is mounted.

3. A pedestal scaffold as set forth in claim 1, wherein said securing means includes a pivotal connection between each of said other ends of said outrigger members and said base member for pivotal movement of said outrigger member between an upper storage position adjacent said mast and an outward use position, and wherein said securing means also includes a brace for each outrigger member, each brace including:

first and second brace tubes each having first and second ends, means pivotally connecting the first ends of said first and second brace tubes together for pivotal movement of said tubes between a generally parallel relationship and an in-line relationship, means pivotally connecting the second end of said first brace tube to its associated outrigger member at a point thereon away from said base member, means pivotally connecting the second end of said second brace tube relative to said base member and above the pivotal connection of its associated outrigger member to said base member, means for releaseably locking said first and second brace tubes against relative movement therebetween when said brace tubes are in said in-line relationship.

4. A pedestal scaffold as set forth in claim 3, and further including:

means for adjusting the spacing between each ground-engageable pad and the outrigger member on which it is mounted.

5. A pedestal scaffold as set forth in claim 1 and further including:

third and fourth outrigger members, each having a ground-engageable pad at one end thereof, securing means for connecting the other end of each of said third and fourth outrigger members to said base member and for holding the pad ends of said third and fourth outrigger members outwardly from said base member and in generally opposite direction from the first and second outrigger members when outward and for holding the pads of said third and fourth outrigger members when outward against vertical movement relative to said base member.

6. A pedestal scaffold as set forth in claim 5, wherein both of said securing means includes pivotal connections between the other ends of said first, second, third and fourth outrigger members and said base member for pivotal movement of all of said outrigger members between an upper storage position adjacent said mast and an outward use position, and a brace for each outrigger member, each brace including:

first and second brace tubes each having first and second ends, means pivotally connecting the first ends of said first and second brace tubes together for pivotal movement of said brace tubes between a generally parallel relationship and an in-line relationship, means pivotally connecting the second end of said first brace tube to its associated outrigger members at a point thereon away from said base member, means pivotally connecting the second end of said second brace tube relative to said base member and above the pivotal connection of its associated outrigger member to said base member, means for releaseably locking said first and second brace tubes against relative movement therebetween when said brace tubes are in said in-line relationship.

7. A pedestal scaffold as set forth in claim 6, and further including:

means for adjusting the spacing between each ground-engageable pad and the outrigger member on which it is mounted.

* * * * *